US007612281B2

(12) United States Patent
Nakae

(10) Patent No.: US 7,612,281 B2
(45) Date of Patent: Nov. 3, 2009

(54) REVERBERATION EFFECT ADDING DEVICE

(75) Inventor: Tetsuichi Nakae, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 12/255,777

(22) Filed: Oct. 22, 2008

(65) Prior Publication Data

US 2009/0133566 A1 May 28, 2009

(30) Foreign Application Priority Data

Nov. 22, 2007 (JP) ..... 2007-302539

(51) Int. Cl.
*G10H 7/10* (2006.01)

(52) U.S. Cl. ..... 84/630; 84/662; 84/707; 700/94

(58) Field of Classification Search ..... 84/600, 84/630, 662, 707; 700/94
See application file for complete search history.

(56) References Cited

U.S. PATENT DOCUMENTS 4,984,495 A * 1/1991 Fujimori ..... 84/603
6,101,583 A * 8/2000 Suzuki ..... 711/147
6,513,007 B1 * 1/2003 Takahashi ..... 704/258
6,563,869 B1 * 5/2003 Yamada ..... 375/232
6,721,426 B1 * 4/2004 Kurisu et al. ..... 381/63
6,782,105 B1 * 8/2004 Sahara et al. ..... 381/63
6,957,240 B2 * 10/2005 Awad et al. ..... 708/322
6,961,632 B2 * 11/2005 Hashimoto et al. ..... 700/94
7,043,036 B2 * 5/2006 Yamada et al. ..... 381/309
7,076,068 B2 * 7/2006 Sotome et al. ..... 381/17

(Continued)

FOREIGN PATENT DOCUMENTS

JP 2007-202020 A 8/2007

(Continued)

OTHER PUBLICATIONS

Extended European Search Report dated Jun. 2, 2009 (4 pages), issued in counterpart European Application Ser. No. 08291058.9.

*Primary Examiner*—David S. Warren
(74) *Attorney, Agent, or Firm*—Frishauf, Holtz, Goodman & Chick, P.C.

(57) ABSTRACT

A reverberation effect adding device comprising a first convolution circuit which in turn comprises FIR filters (80-1 to 80-4) and an adder (accumulator) (81) which adds outputs from the FIR filters, a moving average circuit (82) which receives musical sound waveform data delayed by a predetermined number of stages in the first convolution circuit and which outputs averaged second musical sound waveform data obtained by sampling at a second sampling frequency lower than the first sampling frequency, a second convolution circuit which in turn comprises FIR filters (80-5 to 80-28) which sequentially receive the second musical sound waveform data obtained by sampling at the second sampling frequency and an adder (accumulator) (83), an interpolator (84) which receives an output from the adder (83) of the second convolution circuit, calculates an interpolated value of the output value from the adder (83), and provides the output from the adder (83) and the interpolated value from the interpolator (84) sequentially at the first sampling frequency, and an adder (85) which adds the outputs from the adder (81) and the interpolator (84) and outputs a result of the addition as reverberation data.

6 Claims, 12 Drawing Sheets

U.S. PATENT DOCUMENTS 7,082,201 B2 * 7/2006 Sotome et al. ..... 381/17
7,110,554 B2 * 9/2006 Brennan et al. ..... 381/94.7
7,146,296 B1 * 12/2006 Carlbom et al. ..... 703/5
7,162,047 B2 * 1/2007 Yamada et al. ..... 381/309
7,217,879 B2 * 5/2007 Ito ..... 84/630
7,257,230 B2 * 8/2007 Nagatani ..... 381/56
7,369,663 B2 * 5/2008 Sekine ..... 381/63
2003/0086572 A1 * 5/2003 Sotome et al. ..... 381/17
2003/0159569 A1 * 8/2003 Ohta ..... 84/630
2003/0169887 A1 * 9/2003 Fujita et al. ..... 381/63
2003/0172097 A1 * 9/2003 McGrath ..... 708/300
2003/0202667 A1 * 10/2003 Sekine ..... 381/63
2005/0157891 A1 * 7/2005 Johansen ..... 381/103
2005/0216211 A1 * 9/2005 Nagatani ..... 702/56
2005/0223050 A1 * 10/2005 Liu et al. ..... 708/420
2006/0009986 A1 * 1/2006 Hashimoto et al. ..... 704/501
2006/0018486 A1 * 1/2006 Neoran et al. ..... 381/63
2006/0045294 A1 * 3/2006 Smyth ..... 381/309
2006/0086237 A1 * 4/2006 Burwen ..... 84/630
2006/0104455 A1 * 5/2006 Malvar et al. ..... 381/71.12
2006/0198538 A1 * 9/2006 Malvar et al. ..... 381/95
2006/0198542 A1 * 9/2006 Benjelloun Touimi et al. ..... 381/307
2006/0233381 A1 * 10/2006 Seo et al. ..... 381/56
2007/0025560 A1 * 2/2007 Asada ..... 381/61
2007/0074621 A1 * 4/2007 Chun ..... 84/630
2007/0183602 A1 * 8/2007 Takahashi et al. ..... 381/17
2007/0223708 A1 * 9/2007 Villemoes et al. ..... 381/17
2007/0253574 A1 * 11/2007 Soulodre ..... 381/94.2
2007/0291951 A1 * 12/2007 Faller ..... 381/22
2008/0025519 A1 * 1/2008 Yu et al. ..... 381/17
2008/0069366 A1 * 3/2008 Soulodre ..... 381/63
2008/0085008 A1 * 4/2008 Vickers ..... 381/63
2008/0212809 A1 * 9/2008 Smirnov et al. ..... 381/309
2008/0247553 A1 * 10/2008 Katayama ..... 381/17
2008/0273708 A1 * 11/2008 Sandgren et al. ..... 381/63
2008/0279389 A1 * 11/2008 Yoo et al. ..... 381/18
2009/0010460 A1 * 1/2009 Diedrichsen ..... 381/300
2009/0043591 A1 * 2/2009 Breebaart et al. ..... 704/500
2009/0052680 A1 * 2/2009 Wang et al. ..... 381/59
2009/0052681 A1 * 2/2009 Schobben et al. ..... 381/63
2009/0103737 A1 * 4/2009 Kim et al. ..... 381/17
2009/0103738 A1 * 4/2009 Faure et al. ..... 381/17
2009/0133566 A1 * 5/2009 Nakae ..... 84/603

FOREIGN PATENT DOCUMENTS

WO 2005/036523 A1 4/2005

* cited by examiner

FIG. 5

502 501 503 511 512

| CLOCK | READ DATA | MULTIPLY | ADD |
|---|---|---|---|
| 1 | a[0],X[n] | | |
| 2 | a[1],X[n-1] | X[n]*a[0]→Z[0] | |
| 3 | a[2],X[n-2] | X[n-1]*a[1]→Z[1] | Z[0]→Y[0] 521 |
| 4 | a[3],X[n-3] | X[n-2]*a[2]→Z[2] | Z[1]+Y[0]→Y[1] |
| 5 | a[4],X[n-4] | X[n-3]*a[3]→Z[3] | Z[2]+Y[1]→Y[2] |
| ⋮ | ⋮ | ⋮ | ⋮ |
| m | a[m],X[n-m] | ⋮ | ⋮ |
| m+1 | | X[n-m]*a[m]→Z[m] | |
| m+2 | | | Z[m]+Y[m-1]→Y[m] |

REVERBERATION EFFECT ADDING DEVICE

CROSS-REFERENCE TO RELATED APPLICATION

This application is based upon and claims the benefit of priority from the prior Japanese Patent Application No. 2007-302539, filed Nov. 22, 2007, the entire contents of which are incorporated herein by reference.

BACKGROUND OF THE INVENTION

1. Field of the Invention

The present invention relates to reverberation effect adding devices which add reverberations to a musical sound.

2. Description of the Related Art

Generally, in reverberation effect adding devices, musical sound waveform data is subjected to a filtering process by a digital filter. As the digital filter, a FIR (Finite Impulse Response) filter or an FIR (Infinite Impulse Response) filter is used.

When the FIR filter is used, a convolution operation is performed between received musical sound signal data X[n−k] (k=0, 1, 2, . . . , n−1) and an impulse response a[k] obtained from a reverberation characteristic of a music hall, thereby providing resonance data $Y[n]=\Sigma x[n-]\times a[k]$.

For example Japanese Published Unexamined Patent Application 2007-202020 discloses a first signal processing system which convolutes a direct sound part of an impulse response and a second signal processing system provided in parallel with the first signal processing system and which convolutes a reflected sound part of an impulse response such that the second signal processing system uses a downsampled sampling signal compared to the first signal processing system.

This techniques requires not only a convolution operation circuit which includes the two FIR filters, but also two system impulse response data. Thus, many circuit components and data are required. Since the two signal processing systems are provided in parallel, the impulse response coefficients can be zero such that one of the signal processing systems does not virtually perform the operation and hence parts of the circuits and operations becomes useless.

It is therefore an object of the present invention to provide a reverberation effect adding device which includes no useless circuits and which is capable of producing a high quality reverberation continuing for a long time.

SUMMARY OF THE INVENTION

In order to achieve the above object, one aspect of the present invention provides a reverberation effect adding device comprising: an impulse response coefficient memory which has stored a plurality of impulse response coefficients; first convolution means for receiving n musical sound waveform data sequentially in time series order, for sequentially delaying the first (n−1) ones of the n musical sound waveform data by (n'1), (n−2), . . . , and 1 stages, respectively, in a received order at a first sampling period, for reading n corresponding impulse response coefficients from the impulse response coefficient memory, for multiplying the delayed first (n−1) musical sound waveform data and the last received musical sound waveform data by the read n corresponding impulse response coefficients, respectively, and for adding respective results of the multiplications, thereby outputting a result of the addition; conversion means for converting an output period of the n musical sound waveform data delayed by the n stages by the first convolution means to a second sampling period longer than the first sampling period, and for outputting the musical sound waveform data at the second sampling period; second convolution means for sequentially receiving m ones of the musical sound waveform data outputted by the conversion means, for sequentially delaying the first (m−1) ones of the m musical sound waveform data by (m−1), (m−2), . . . , and 1 stages, respectively, in a received order at a second sampling period, for reading (m−1) corresponding impulse response coefficients and another impulse response coefficient corresponding to the last received musical sound waveform data from the impulse response coefficient memory, for multiplying the delayed first (m−1) musical sound waveform data and the last received musical sound waveform data by the read m corresponding impulse response coefficients, respectively, and for adding respective results of the multiplications, thereby outputting at the second sampling period a result of the additions; inverse conversion means for inversely converting an output period of the results of the additions outputted from the second convolution means from the second sampling period to the first sampling period, thereby outputting the result of the additions at the first sampling period; and addition means for adding the result of the additions outputted from the inverse conversion means at the first sampling period and the result of the addition outputted from the first convolution means.

In order to achieve the above object, another aspect of the present invention provides a reverberation effect adding device comprising: an impulse response coefficient memory which has stored a plurality of impulse response coefficients; a plurality of ($1^{st}$-$s^{th}$) convolution means where s=2, 3, 4, . . . S each for receiving n musical sound waveform data sequentially in time series order, for sequentially delaying the received first (n−1) ones of the n musical sound waveform data by (n−1), (n−2), . . . , and 1 stages, respectively, in a received order at a sampling period set in that convolution means, the sampling period set in any $s^{th}$ convolution means being shorter than that of $(s+1)^{th}$ convolution means of following order, for reading n impulse response coefficients corresponding to the delayed first (n−1) musical sound waveform data and the last received musical sound waveform data from the impulse response coefficient memory, for multiplying the delayed first (n—1) musical sound waveform data and the last received musical sound waveform data by the read n corresponding impulse response coefficients, respectively, and for adding respective results of the multiplications, thereby outputting a result of the addition; a plurality of conversion means each provided for a respective one of the plurality of convolution means excluding the $1^{st}$ convolution means for converting an output period of the musical sound waveform data outputted from that convolution means to the sampling period set in the convolution means of following order, and for supplying the musical sound waveform data at the converted sampling period to the convolution means of following order; a plurality of inverse conversion means each provided for a respective one of the plurality of convolution means excluding the $1^{st}$ convolution means for inversely converting an output period of the result of the addition outputted sequentially from that convolution means to the sampling period of the convolution means of preceding order; and a plurality of addition means each provided for a respective one of the plurality of convolution means excluding the $S^{th}$ convolution means for adding the result of the addition outputted from that convolution means, whose sampling period is changed to the sampling period set in the conversion means of preceding order, by the inverse conversion means provided for that convolution means and the result of the addition outputted from the convolution means of preceding order, and for outputting a result of the addition to the conversion means provided for the convolution means of preceding order.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 5 illustrates a pipeline system.

DETAILED DESCRIPTION OF THE PREFERRED EMBODIMENTS

Figure 1:
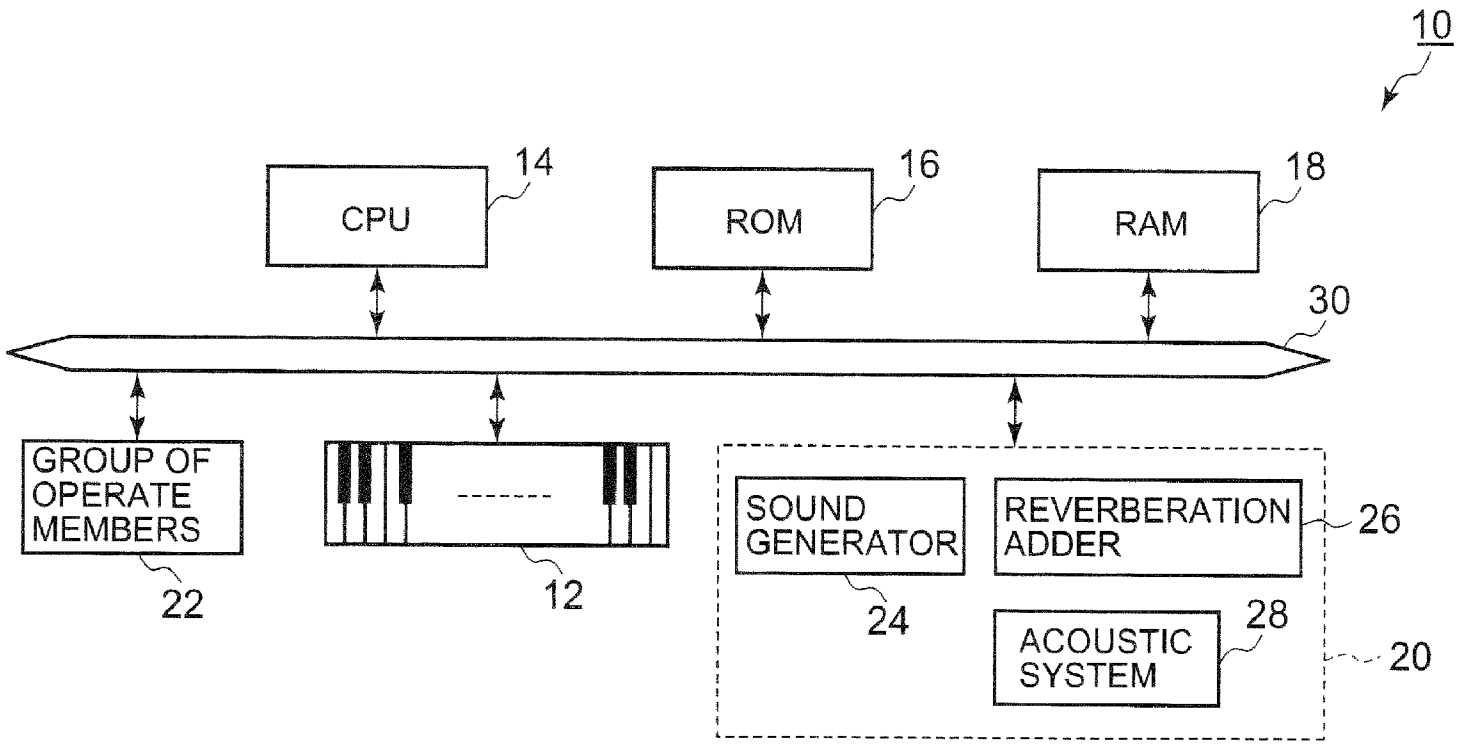
FIG. 1 is a block diagram of an electronic musical instrument according to one embodiment of the present invention.

Referring to the accompanying drawings, one embodiment of the present invention will be described. FIG. 1 is a block diagram of an electronic musical instrument according to one embodiment of the present invention. In the embodiment, the electronic musical instrument has a reverberation adding circuit.

As shown in FIG. 1, the electronic musical instrument 10 of this embodiment comprises a keyboard 12, a CPU 14, a ROM 16, a RAM 18, a musical sound generator 20 and a group of operate elements 22 which may, for example, be numeric keys or switches each to be depressed to specify a tone color number of musical sound data. These elements are connected by a bus 30. The musical sound generator 20 comprises a sound generator circuit 24, a reverberation adding circuit 26 and an acoustic system 28.

The keyboard 18 transmits to the CPU 14 information which specifies a depressed key and information indicative of a velocity of a key depressed by a performer as he or she performs the instrument.

The CPU 14 controls the system, and generates control signals applied to the musical sound generator 20 to produce a musical sound with a pitch corresponding to the depressed key, and control signals applied to the reverberation adding circuit 20. The ROM 16 has stored programs, constants used to execute the programs, waveform data based on which musical sound waveform data is produced by the musical sound generator 20, and impulse response data including impulse response coefficients to be used in the reverberation adding circuit 26. The RAM 18 temporarily stores variables required in the execution of the programs, values obtained by operations, parameters, input data and output data.

Figure 2:
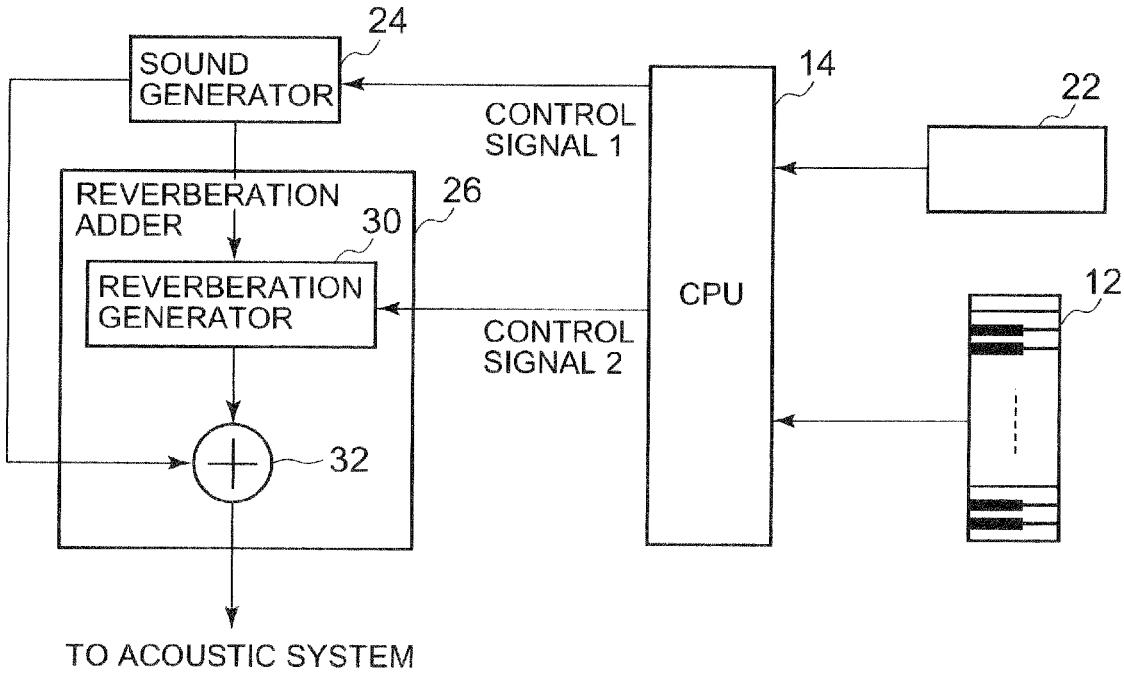
FIG. 2 is a block diagram of a circuit including a sound generator, a reverberation adding circuit and related components of the embodiment of the present invention.

FIG. 2 is a block diagram of a circuit of the sound generator 24, reverberation adding circuit 26 and related components in this embodiment.

As shown in FIGS. 1 and 2, the sound generator 24 generates musical sound waveform data X[n] with a predetermined tone color and a predetermined pitch based on tone color information indicative of a tone color of a musical sound to be produced, pitch information indicative of a pitch of the musical sound and its velocity information, which compose a control signal 1.

The pitch information and the velocity information included in the control signal 1 are produced by the CPU 14 based on signals from the keyboard 12. The tone color information included in the control signal 1 is produced by the CPU 14 based on tone color information specified by one of the plurality of operate members 22 operated by the performer.

The reverberation adding circuit 26 comprises a reverberation generator 30, which comprises a plurality of convolution circuits, and an adder 32. The reverberation adding circuit 26 generates reverberation data based on the musical sound waveform data in accordance with a control signal 2 which is generated by the CPU 12 and produces a composite signal of the musical sound waveform data and the reverberation data. As shown in FIG. 2, the control signal 2 is applied to the reverberation generator 30.

The acoustic system 28 comprises a D/A converter, an amplifier and a speaker such that composite data is converted to an analog signal, which is then amplified and emanated from the speaker.

Figure 3:
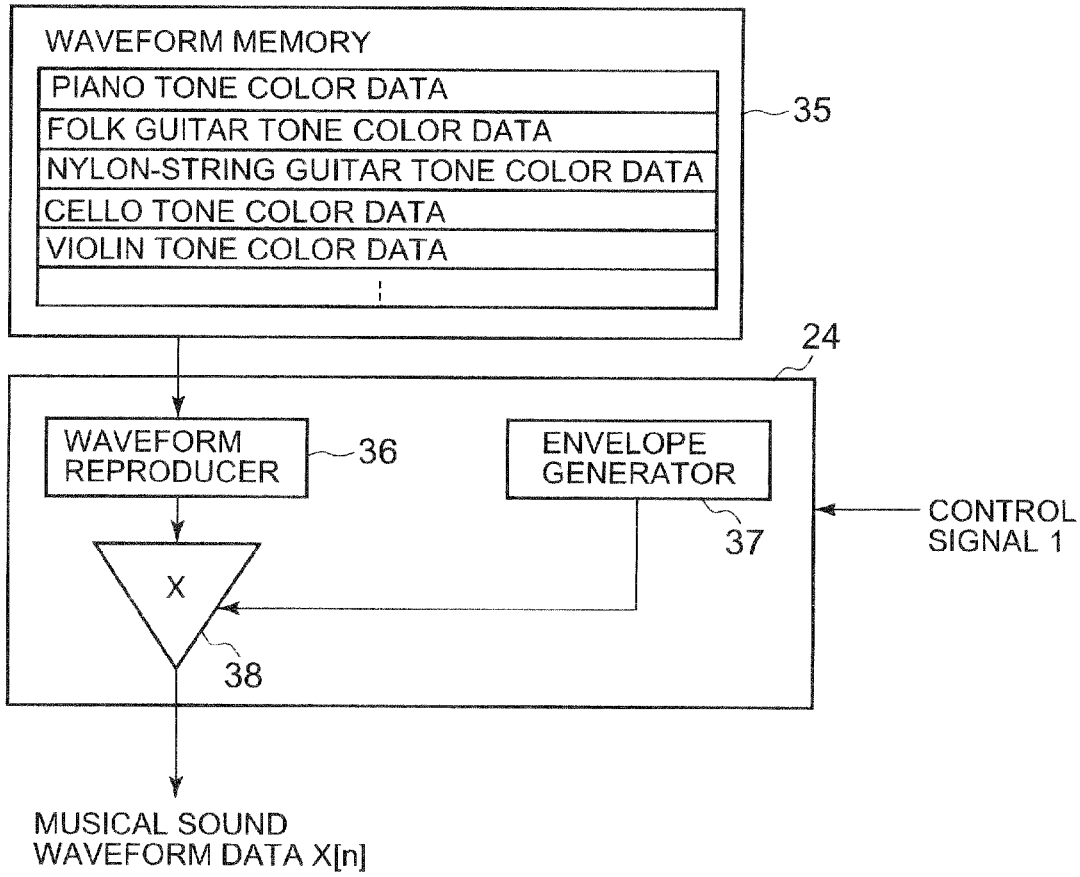
FIG. 3 is a block diagram of a circuit including the sound generator and a waveform memory of the embodiment.

FIG. 3 is a block diagram of a circuit including the sound generator 24 and a waveform memory 35 of the embodiment. As shown in FIG. 3, the sound generator 24 comprises a waveform reproducer 36, an envelope generator 37 and a multiplier 38.

The waveform memory 35 has stored various tone color waveform data such as piano tone color data and folk guitar tone color data. The waveform memory 35 is implemented, for example, by the ROM 16. The waveform reproducer 36 reads waveform data of a predetermined type (for example, a piano tone color) in accordance with tone color and pitch information included in the control signal 1 from the various tone color data stored in the waveform memory 35. The envelope generator 37 outputs envelope data in accordance with velocity information included in the control signal 1. The waveform data is multiplied by the envelope data in the multiplier 38, thereby outputting musical sound waveform data X[n].

In the embodiment, impulse response data including impulse response data coefficients to be multiplied by the respective values of the musical sound waveform data are stored for each tone color in the impulse response memory (not shown). For example, when the waveform memory 35 of FIG. 3 is used as the impulse response memory, it stores piano tone color impulse response data, folk guitar tone color impulse response data, nylon-string guitar tone color impulse response data, cello tone color impulse response data, and violin tone color impulse response data. The impulse response memory may be implemented by the ROM 16. The control signal 2 includes information which selects impulse response data.

A general convolution circuit performs a convolution operation in accordance with the following expression:

$$Y[n]=\Sigma X[n-k]\times a[k](k=0, 1, 2, \ldots, m)$$

where Y[n] is reverberation data output, X[n−k] is musical sound waveform data, and a[k] is an impulse response coefficient.

Figure 4:
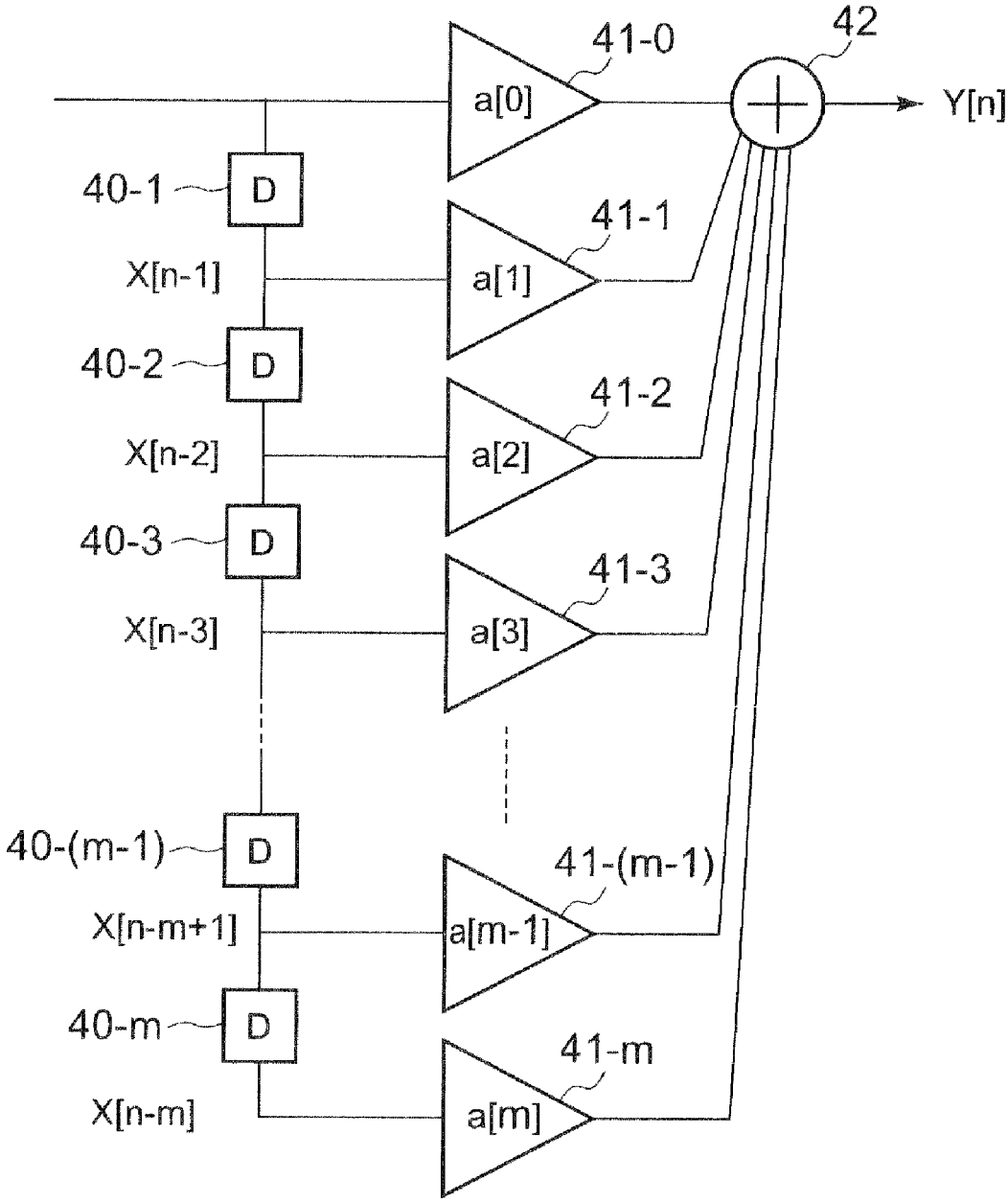
FIG. 4 PRIOR ART
FIG. 4 is a schematic block diagram of a prior art general convolution circuit.

FIG. 4 is a block diagram of a general convolution circuit, which is a so-called FIR filter The convolution circuit comprises a series of delay circuits 40-1 to 40-m which each delay received data (for example, of musical sound waveform data X[n]) by one clock cycle, a plurality of multipliers 41-0 to 41-m which each multiply musical sound waveform data or output data from an associated delay circuit by an impulse response coefficient a[k], and an adder 42 which adds the outputs from the multipliers 41-0 to 41-m.

Since the number of taps of each FIR filter is large or, for example, 1024, many delay circuits and multipliers are required. Actually, a pipeline system is used to read data, and perform multiplication in each multiplier and addition in adders in a parallel manner, thereby realizing a FIR filter including a reduced number of multipliers and adders.

For example, the FIR filter comprises a shift register which stores delayed musical sound waveform data and shifts it in accordance with a clock, multipliers which each multiply musical sound waveform data stored in a predetermined stage of the shift register by a corresponding impulse response coefficient, an adder (accumulator) which adds data stored therein and outputs from the multipliers, thereby performing the respective processes in these circuits in parallel in a pipeline system.

FIG. 5 illustrates the pipeline system. As shown in FIG. 5, the FIR filter acquires musical sound waveform data X[n] and an impulse response coefficient a[0] (reference numeral 601) at the time of a first clock signal (clock=1) (reference numeral 501) and then multiplies the musical sound waveform data X[n] by the impulse response coefficient a[0] at the time of a second clock signal (clock=2), thereby acquiring a multiplied value Z[0] (reference numeral 511). At the time of the second clock signal (clock=2), the FIR filter acquires musical sound waveform data X[n−1] and an impulse response coefficient a[1] in parallel with the multiplication, as shown in FIG. 5.

Further, at the time of a next clock signal (clock=3), the adder (accumulator) adds a value accumulated therein, where an initial value accumulated therein is 0, and the multiplied value Z[0], thereby providing an accumulated value Y[0] (reference numeral 521). Even at the time of the clock signal (clock=3), the FIR filter acquires musical sound waveform data X[n−2] and an impulse response coefficient a[2] (reference numeral 503) and multiplies the musical sound waveform data X[n−1] by the impulse response coefficient a[1], thereby providing a multiplied value Z[1] (reference numeral 512) in parallel.

In the pipeline system, a high-speed multiply-add operation is fulfilled by the reduced number of multipliers and adders. However, if it is considered that a sampling frequency for the musical sound waveform data is 44.1 kHz, the multiply-add operation must be terminated completely in 22.7 μs. Even if the operation clock for the FIR filter is 50 MHz, which provides a high speed operation, a time required for one clock is 20 ns. Thus, 22.7 μs/20 ns=1135 and hence the number of taps of the FIR is approximately 1100. Actually, a FIR filter with approximately 1100 taps is insufficient to produce a reverberation.

If a plurality of FIR filters with 1024 taps capable of performing a multiply-add operation are provided such that musical sound waveform data delayed by each upstream one of the FIR filters is inputted into an adjacent downstream one of the FIR filters and multiply-add values each output from a respective one of the FIR filters are added, a combination of FIR filter with more taps will be fulfilled without reducing the sampling frequency.

Figure 6:
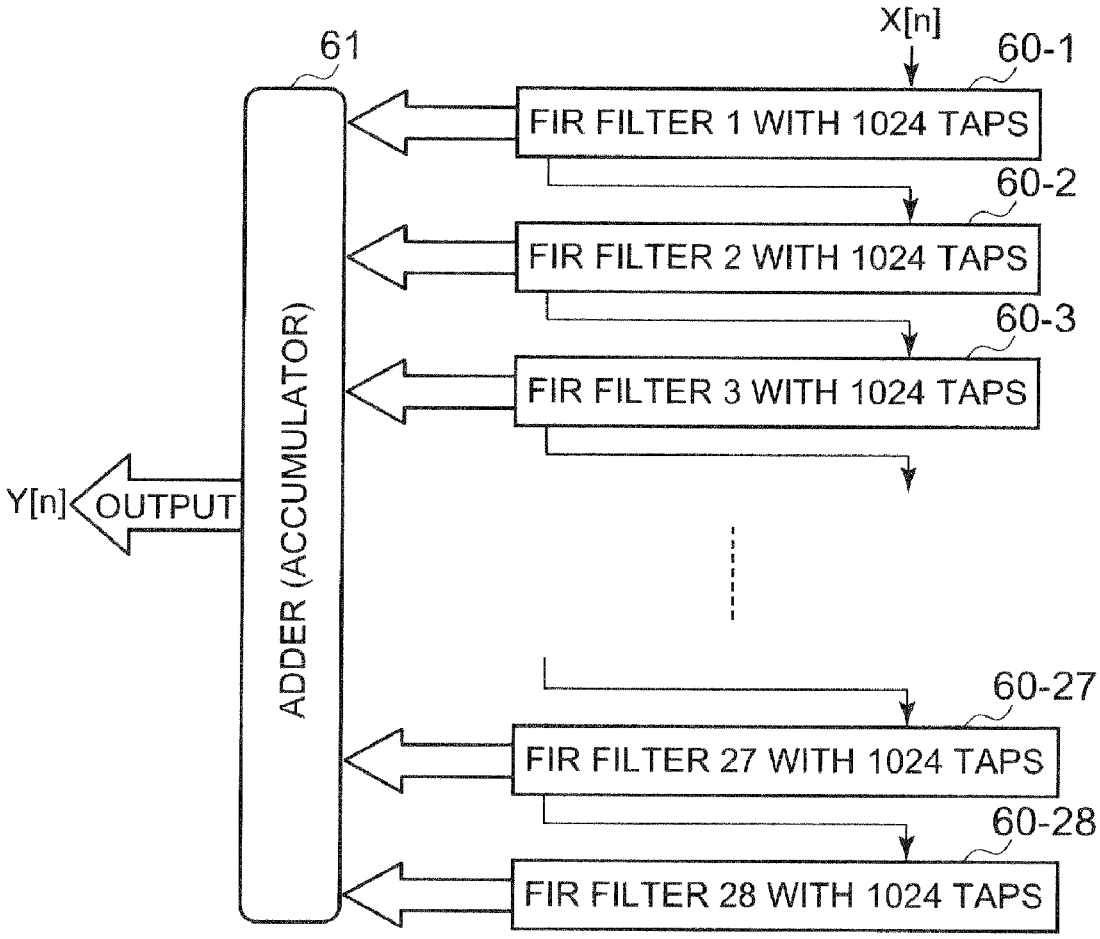
FIG. 6 PRIOR ART
FIG. 6 illustrates a prior art reverberation generator which includes 28 FIR filters with 1024 taps.

FIG. 6 illustrates a reverberation generator which comprises 28 FIR filters 60-1 to 60-28 with 1024 taps and an adder (accumulator) 61 which adds the outputs from the FIR filters 60-1 to 60-28. In each FIR filter, the musical sound waveform data is shifted at each clock in the shift register and finally output from the FIR filter. For example, the musical sound waveform data output from the most upstream FIR filter 60-1 is inputted to an adjacent downstream FIR filter 60-2.

The adder (accumulator) 61 adds a value accumulated therein (initially-0) and a multiply-add value of a respective one of the FIR filters 60-1 to 60-28 outputted in this order. By adding the multiply-add values of all the FIR filters in this manner, reverberation data Y[n] is obtained.

The use of the 28 FIR filters with 1024 taps implements a combination of FIR filter with 28672 taps. While the adder (accumulator) 61 requires 28 accumulations, the processing and accumulation of the FIR filters with 1024 taps only requires approximately 1052 (=1024+28) clock cycles, which falls within the range of 1135 clocks, as mentioned above.

Figure 7:
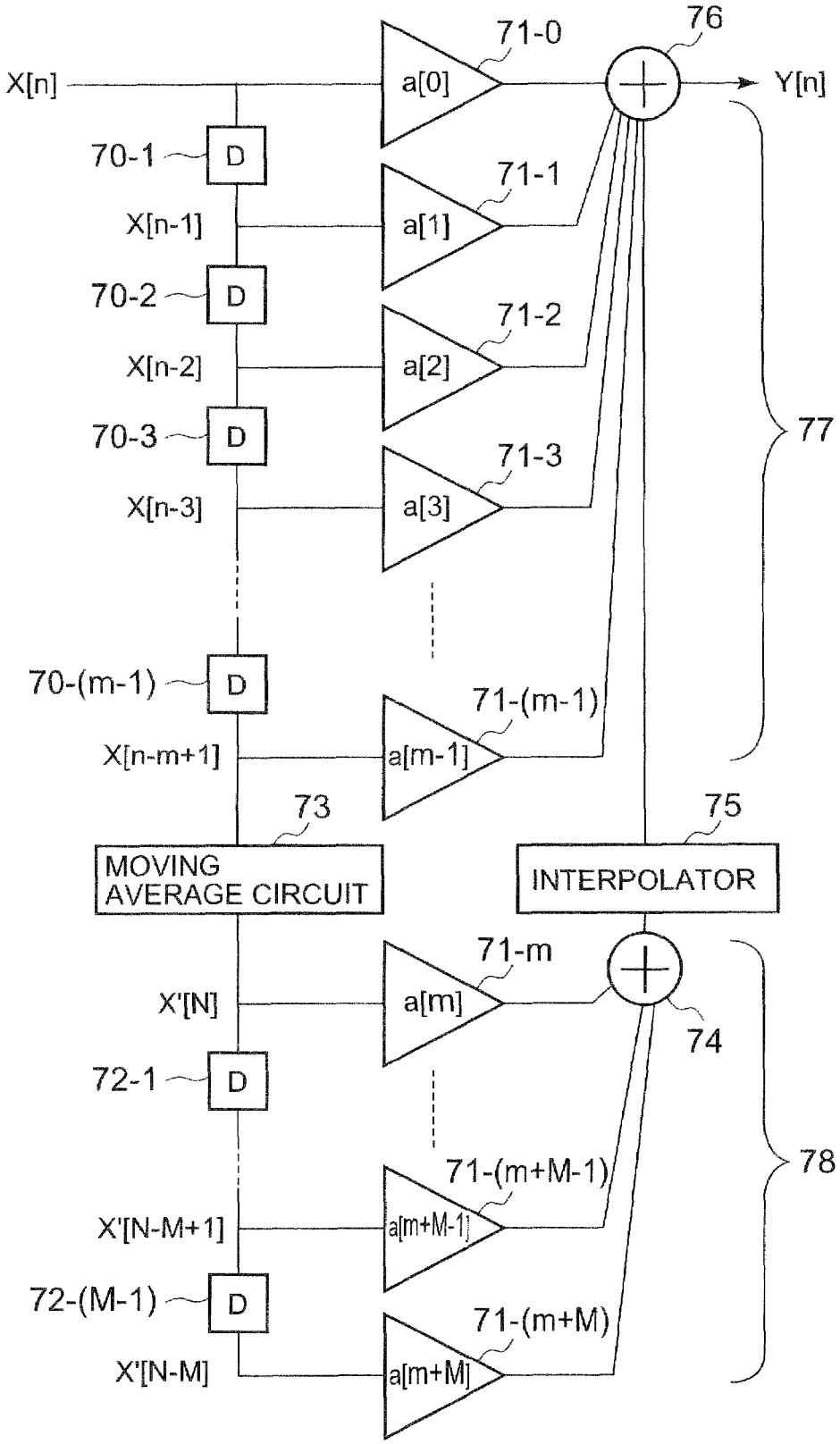
FIG. 7 is a block diagram of a component which generates a control signal 3 according to the embodiment.

The reverberation generator 30 according to one embodiment of the present invention will be described. FIG. 7 is a block diagram of the reverberation generator. As shown in FIG. 7, the reverberation generator 30 comprises a plurality of series connected delay circuits 70-1 to 70-(m−1) which each delay received data (for example, of musical sound waveform data X[n]) by one clock cycle, and a plurality of multipliers 71-0 to 71-(m−1) where the multiplier 71-0 receives musical sound data X[n] directly and multiplies same by an impulse response coefficient a[0] and where the multipliers 71-1 to 71-(m−1) each receive musical sound data through an associated delay circuit and multiply this data by a corresponding impulse response coefficient a[k] (k=1, 2, . . . (m−1)).

In addition, the reverberation generator 30 comprises a moving average circuit 73 which receives a plurality of musical sound waveform data obtained by sampling at a first sampling frequency $FS_1$, takes an averaged value of the plurality of musical sound data and produces average second musical sound waveform data by sampling at a second sampling frequency $FS_2$ ($FS_2<FS_1$). In this embodiment, the moving average circuit corresponds to conversion means which converts the first sampling period of output musical sound waveform data to a second longer one. Note that the sampling period=1/the sampling frequency. In this embodiment, the description will be made using the sampling frequency.

The reverberation generator 30 also comprises a plurality of series connected delay circuits 72-1 to 72-(M−1) which each delay the second musical sound waveform data by one clock cycle, a plurality of multipliers 71-m to 71-(m+M) where the multiplier 71-m multiplies an output from the moving average circuit 73 by impulse response data a[m], and the multipliers 71-(m+1) to 71-(m+M) each multiply output data from a respective one of the delay circuits 72-1 to 72-(M−1) by impulse response data a(k) (k=m, m+1, m+2, . . . , (m+M)), an adder 74 which adds outputs 25 from the multipliers 71-m to 71-(m+M), an interpolator 75 which interpolates output data (sampled at the second sampling frequency $FS_2$) from the adder 74 and outputs data sampled at the first sampling frequency $FS_1$, a second adder 76 which adds the outputs from the multipliers 71-0 to 71-(m−1) and the output from the interpolator 75. In this embodiment, the interpolator 75 corresponds to inverse conversion means which converts the second sampling period of the output of the adder 74 to the first sampling period.

The delay circuits 70-1 to 70-(m−1), the multipliers 71-0 to 71-(m−1) and the first adder 76 compose a first convolution circuit 77. The delay circuits 72-1 to 72-(M−1), the multipliers 71-m to 71-(m+M) and the adder 74 compose a second convolution circuit 78.

Figure 12:
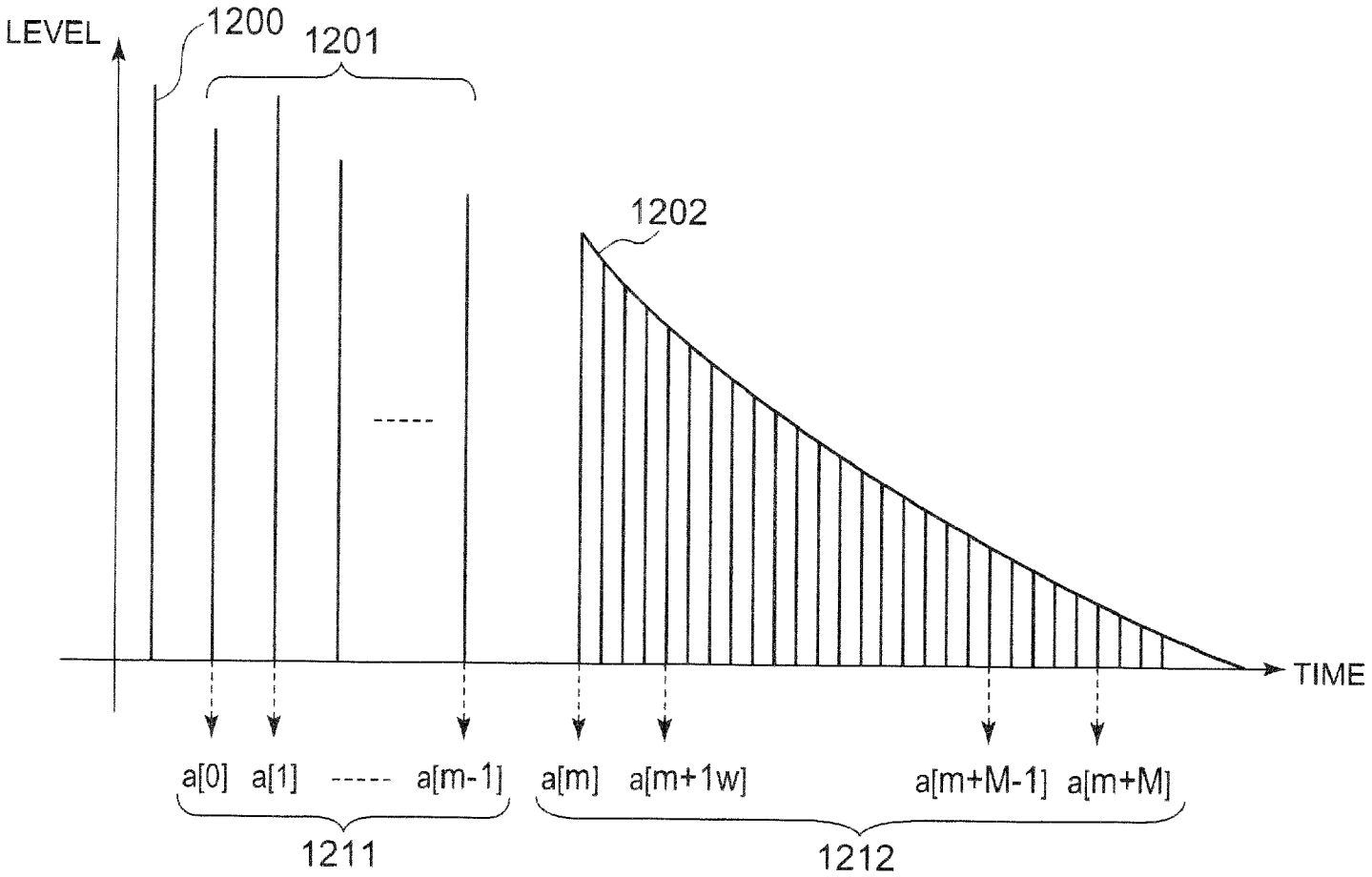
FIG. 12 is a graph illustrating a reverberation.

FIG. 12 is a graph illustrating a reverberation. As shown in FIG. 12, a reverberation for a direct sound (shown by reference numeral 1200) is said to be composed of two parts. One part includes an initial reflected sound (shown by reference numeral 1201) which is a part of a sound produced by a sound source and reflected once by a wall, floor or ceiling. Basically, it is heard several 100 milliseconds after the direct sound is heard. The other part is a later reverberation (shown by reference numeral 1202) which comprises a part of the sound produced from the sound source, reflected more than once and heard approximately 150 milliseconds after the direct sound is heard. A time required for the later reverberation to be attenuated −60 dB compared to the direct sound is hereinafter referred to as a reverberation time.

The later reverberation is sounds reflected repeatedly by walls, floors, ceilings and the audience. Especially, it is considered that its high frequency components are absorbed by the walls, floors, etc. Thus, when reverberation is realized with the FIR filters, the sampling frequency of the later reverberation may be smaller than that of the initial reflected sound.

In this embodiment, the initial reflected sound is obtained by a convolution operation with the musical sound waveform data obtained by sampling at the first sampling frequency $FS_1$ and the impulse response coefficients whereas the later reverberation is obtained by a convolution operation with the sound waveform data obtained by sampling at the second sampling frequency $FS_2$ and the impulse response coefficients.

As shown in FIG. 12, the impulse response coefficients a[0]-a[m−1] are used to reproduce the initial reflected sound (shown by reference numeral 1211). The impulse response coefficients a[m]-a[m+M] are used to reproduce the later reverberation (shown by reference numeral 1212). As just described above, in the present embodiment, only one series of the impulse response data including the impulse response coefficients is required to be stored in a memory such as the ROM 16 as in the usual FIR filters.

In the example of FIG. 7, the sum $Y_1$ of signals from the multipliers 71-0 to 71-[m−1] which corresponds to the initial reflected sound is obtained as follows:

$$Y_1[n]=\Sigma X[n-k]\times a[k](k=0, 1, 2, \ldots, m-1)$$

The sum $Y_2$ of signals from the multipliers 71-m to 71-[m+M] which corresponds to the later reverberation is obtained as follows:

$$Y_2[n]=\Sigma X'[N-k]\times a[m+k](k=0, 1, 2, \ldots, M)$$

where X'[N−k] is an output of the moving average circuit 73. For example, when this output comprises an average of adjacent musical sound waveform data, it is expressed as follows:

$$X'[i]=(X[j]+X[j+1]/2(j=\text{even number})$$

As described above with reference to FIG. 6, the plurality of FIR filters are provided such that delayed musical sound waveform data is applied sequentially from each upstream FIR filter to an adjacent downstream one and the multiply-add outputs from the respective FIR filters are added, thereby implementing an FIR filter device with many taps.

Figure 8:
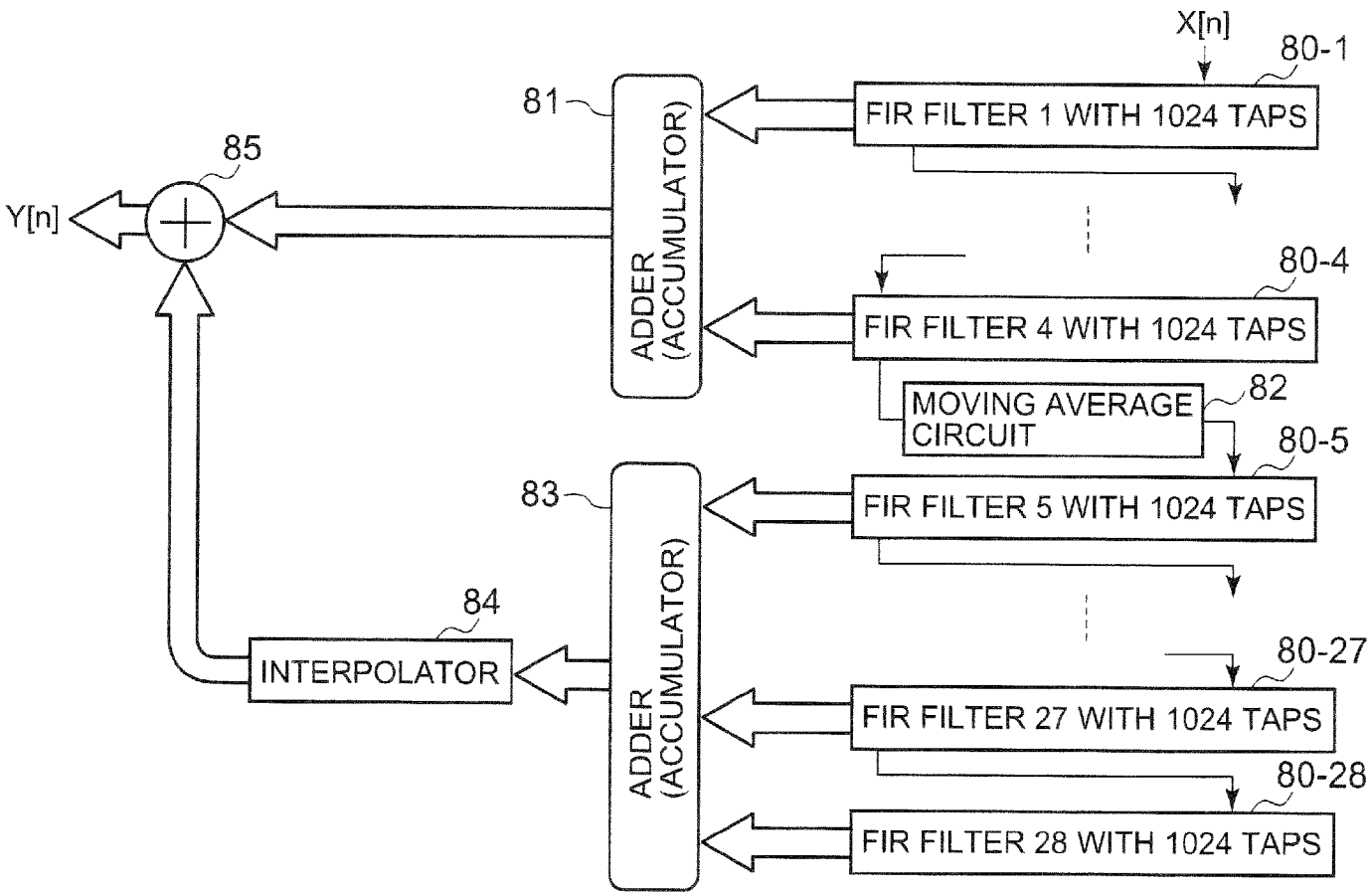
FIG. 8 illustrates a reverberation generator using a plurality of FIR filters according to the embodiment.

FIG. 8 illustrates a reverberation generator using a plurality of FIR filters in this embodiment. Also in this embodiment, the reverberation generator is realized using 28 FIR filters with 1024 taps.

As shown in FIG. 8, the reverberation generator comprises 28 FIR filters 1-28 (shown by reference numerals 80-1 to 80-28), a first adder (accumulator) 81 which adds outputs from the four upstream FIR filters 80-1 to 80-4, a moving average circuit 82, a second adder (accumulator) 83 which adds outputs from the 24 downstream FIR filters 80-5 to 80-28, an interpolator 84 and a third adder 85 which adds the outputs from the first adder (accumulator) 81 and the interpolator 84.

In the example of FIG. 8, the FIR filters 80-1 to 80-4 and the first adder (accumulator) 81 compose a first convolution circuit, and the FIR filters 80-5 to 80-28 and the second adder (accumulator) 83 compose a second convolution circuit.

In the FIR filters 80-1 to 80-4 included in the first convolution circuit, musical sound waveform data obtained by sampling at the first sampling frequency $FS_1$ is shifted at each clock and the musical sound waveform data outputted by each upstream one of the FIR filters 80-1 to 80-3 is inputted to an adjacent downstream one. The musical sound waveform data outputted by the FIR filter 80-4 is inputted to the moving average circuit 82.

Each FIR filter has the same configuration as in FIG. 4 which comprises a multi-stage shift register which stores a plurality of musical sound waveform data, a plurality of multipliers which multiply respective received musical sound waveform data from the shift register by corresponding impulse response coefficients, and an adder (accumulator) which adds a respective output from the multipliers and a value accumulated therein such that the acquisition of the musical sound waveform data, the reading of the impulse response coefficients, the multiplication of the multipliers and the accumulation of the adder (accumulator) are performed in parallel in the pipeline system.

The musical sound waveform data averaged in the moving average circuit 82 is inputted to the FIR filter 80-5. The averaged musical sound waveform data obtained by sampling at the second sampling frequency $FS_2$ is shifted at each clock through the FIR filters 80-5 to 80-27 included in the second convolution circuit. The musical sound waveform data outputted from each upstream one of the FIR filters 80-5 to 80-27 is inputted to an adjacent downstream one.

Figure 9:
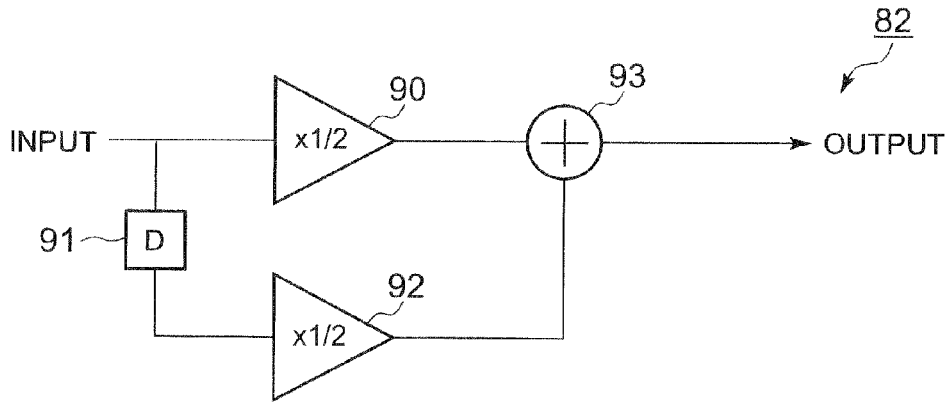
FIG. 9 illustrates a moving average circuit according to the embodiment.

FIG. 9 illustrates the configuration of the moving average circuit 82 in the embodiment of FIG. 8. As shown in FIG. 9, the moving average circuit 82 comprises a multiplier 90 which halves the value of received musical sound waveform data, a delay circuit 91 which delays the musical sound waveform data one clock cycle, a second multiplier 92 which halves the delayed musical sound waveform data from the delay circuit 91, and an adder 93 which adds the data outputted from the multiplications 90 and 92.

The adder 93 adds the two current, and one-clock cycle preceding halved musical sound waveform data from the multipliers 90 and 92, respectively. This produces averaged musical sound waveform data obtained by sampling at the second sampling frequency $FS_2$ which is a half of the first sampling frequency $FS_1$ of the original musical sound waveform data.

Figure 10:
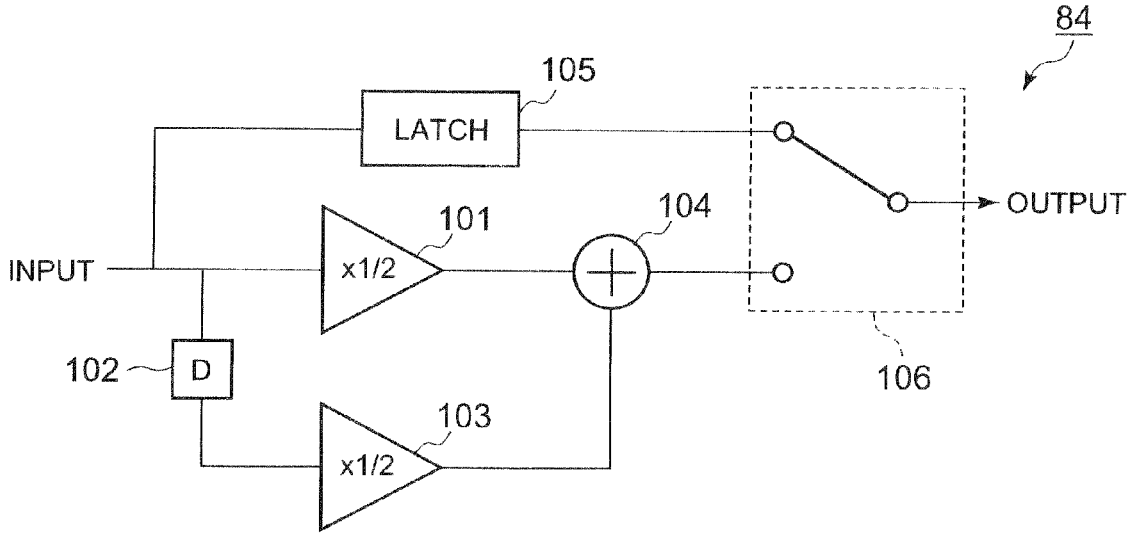
FIG. 10 illustrates an interpolator in the embodiment.

FIG. 10 illustrates the configuration of the interpolator 84 in this embodiment. As shown in FIG. 10, the interpolator 84 comprises a multiplier 101 which halves a received multiply-add value, a delay circuit 102 which delays the received multiply-add value by one clock cycle of the first sampling frequency $FS_1$, a second multiplier 103 which halves the delayed multiply-add value from the delay circuit 102, an adder 104 which adds outputs from the multipliers 101 and 103, a data latch 105 which holds received multiply-add value corresponding to one clock cycle of the first sampling frequency $FS_1$, and a selector 106 which selects one of the outputs from the adder 104 and the latch 105 in accordance with the first sampling frequency $FS_1$.

Figure 11:
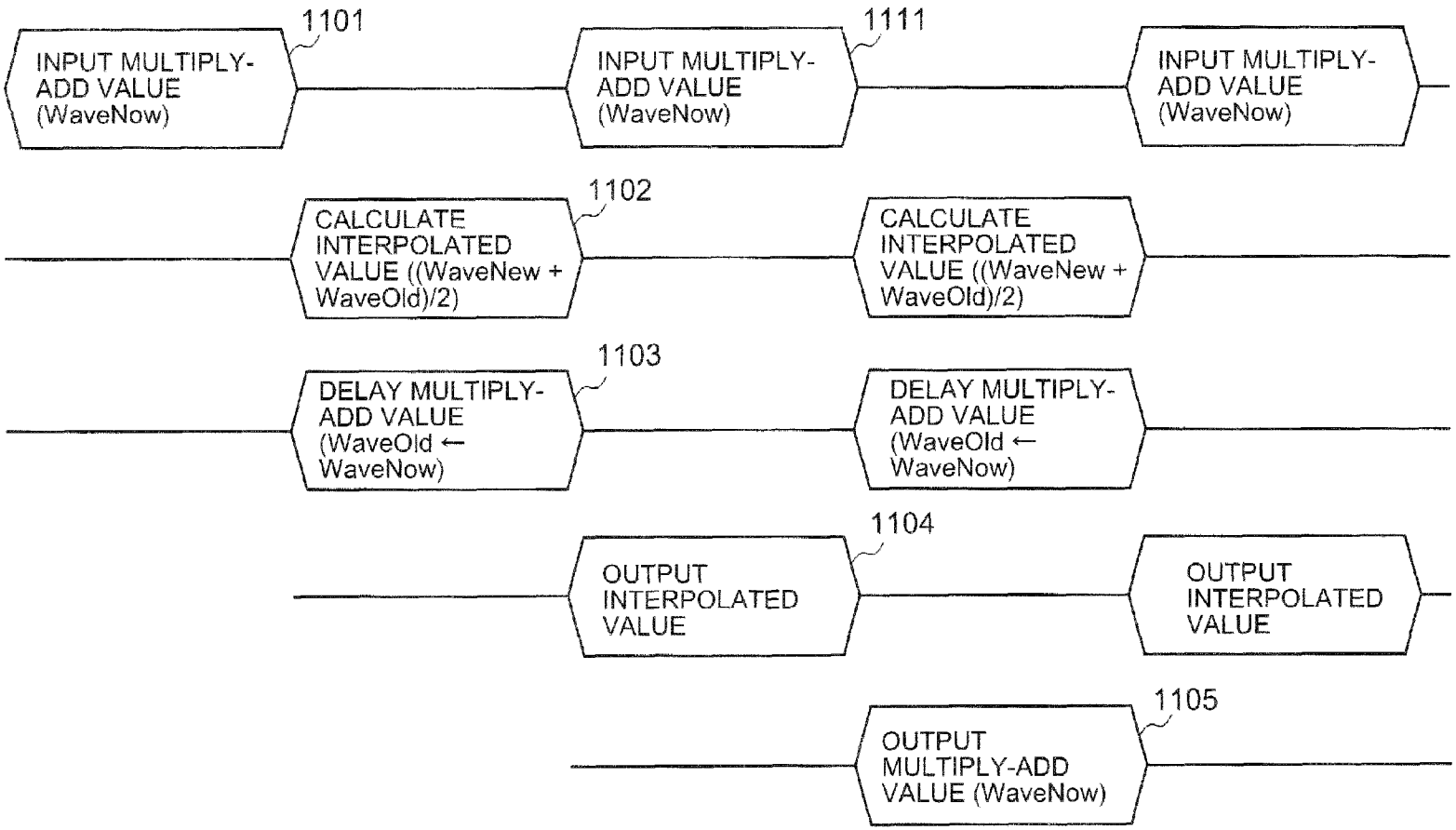
FIG. 11 is a timing chart of operation of the interpolator.

FIG. 11 is a timing chart of operation of the interpolator of this embodiment. In FIG. 11, one clock cycle for the interpolator 84 corresponds to the first sampling frequency $FS_1$. As shown in FIG. 11, the interpolator 84 receives a multiply-add value (WaveNow) at intervals of 2 clocks or at the second sampling frequency $FS_2$ (shown by reference numerals 1101, 1111).

At the time of a next clock, the adder 104 adds the halved multiply-add value (WaveNow) and the delayed halved multiply-add value (WaveOld) ((WaveOld+WaveNow)/2, as shown by reference numeral 1103). The delay circuit 102 delays the multiply-add value (WaveOld←WaveNow, as shown by reference numeral 1103).

At the time of a next clock, the selector 106 selects an interpolated value from the adder 104 and outputs it (shown by reference numeral 1104). At the time of a further next clock, the selector 106 selects a multiply-add value (from the data latch 105) and outputs it (shown by reference numeral 1105).

By repeating such process, an interpolated value ((WaveOld+WaveNew)/2) and a multiply-add value (WaveNew) are outputted repeatedly in this order in accordance with the first sampling frequency $FS_1$.

In FIG. 8, the adder (accumulator) 81 adds the multiply-add values outputted from the FIR filters 80-1 to 80-4. Actually, the adder (accumulator) 81 sequentially adds a value accumulated so far therein (initially 0) and a multiply-add value outputted from a respective one of the FIR filters 80-1 to 80-4 of the first convolution circuit. Thus, the multiply-add values from all the FIR filters 80-1 to 80-4 of the first convolution circuit are accumulated.

The musical sound waveform data averaged by the moving average circuit 82 is obtained by sampling at the second sampling frequency $FS_2$ which is a half of the first sampling frequency $FS_1$. Thus, if the FIR filters 80-4 to 80-28 of the second convolution circuit have the same number of taps as the FIR filters 80-1 to 80-4 of the first convolution circuit, the former realize multiplication of respective averaged musical sound data by corresponding impulse response coefficients twice as many as those used in the FIR filters 80-1 to 80-4 of the first convolution circuit in the time base direction.

The multiply-add values outputted from the FIR filters 80-5 to 80-28 of the second convolution circuit are added in the adder (accumulator) 83. Like the adder (accumulator) 81, the adder (accumulator) 83 sequentially adds a value accumulated so far therein (initially 0) and a multiply-add value from a respective one of the FIR filters 80-5 to 80-28. Thus, the multiply-add values from all the FIR filters 80-5 to 80-28 of the second convolution circuit are accumulated.

An output from the adder (accumulator) 83 obtained by sampling at the second sampling frequency $FS_2$ is inputted to the interpolator 84, which, as described above, interpolates data received sequentially from the adder 83 and outputs an interpolated value and a multiply-add value sequentially at the first sampling frequency $FS_1$.

The adder 85 adds the outputs from the adder (accumulator) 81 and the interpolator 84 and outputs a result of the addition as reverberation data Y (n). Actually, the accumulated output indicative of the multiply-add value from the adder (accumulator) 81 is delayed by a predetermined time so as to be outputted at the same time as the output from the interpolator 84.

As shown in FIG. 2, the adder 32 adds the reverberation data Y (n) from the reverberation generator 30 and the musical sound waveform data from the sound generator 24. The musical sound waveform data with reverberation data from the adder 32 is delivered to the acoustic system 28, which then emanates the waveform data as an acoustic signal from the speaker.

As described above, as shown in FIG. 7, this embodiment comprises the delay circuit 70-1 to 70-(m−1) which delays musical sound waveform data obtained by sampling at the first sampling frequency, the multipliers 71-0 to 71-(m−1) which multiply the latest musical sound waveform data and the delay circuit-delayed musical sound waveform data by corresponding predetermined impulse response coefficients, respectively, and the adder 76 which adds the outputs from the multipliers.

In this embodiment, the moving average circuit 73 is provided which receives musical sound waveform data delayed sequentially by an amount corresponding to a predetermined number of stages by the delay circuits of the first convolution circuit 77 and outputs averaged second musical sound waveform data obtained by sampling at the second sampling frequency $FS_2$ smaller than the first sampling frequency $FS_1$.

In this embodiment, the second convolution circuit 78 comprises the plurality of delay circuits 72-1 to 72-(M−1) which sequentially delay the second musical sound waveform data obtained by sampling at the second sampling frequency $FS_2$, the plurality of multipliers 71-m to 71-(m+M) which multiply the latest second musical sound waveform data from the moving average circuit 73 and the respective second delayed musical sound waveform data from the associated delay circuits 72-1 to 72-(M−1) by the corresponding predetermined impulse response coefficients, and the adder 74 which adds the outputs from the multipliers.

In addition, in the present embodiment, the interpolator 75 is provided which receives an output from the adder 74 of the second convolution circuit 78, calculates an interpolated value of the output from the adder 74, and outputs the output from the adder 74 and its interpolated value sequentially The adder 76 of the first convolution circuit 77 adds the outputs from the respective multipliers 71-0 to 71-(m−1) and the output from the interpolator 75, thereby providing a result of the addition as reverberation data.

Since the embodiment has the configuration mentioned above, it is only required to hold a single series of impulse response coefficients a(k) (k=0, 1, 2, . . . , (m−1), m, . . . , (m+M), thereby preventing possible nonuse of data and an increase in its amount due to storage of a plurality of series of impulse response data, which is required in the prior art.

According to the present embodiment, when the musical sound waveform data obtained by sampling at the first sampling frequency $FS_1$ is averaged, second musical sound waveform data obtained by sampling at the first sampling frequency $FS_1$ is produced. Then, the second convolution circuit convolutes the second musical sound waveform data Thus, reverberation continuing for a longer time and disappearing in a natural manner is produced by a circuit simplified compared to the prior art circuit.

In the present embodiment, the first convolution circuit comprises the shift register which stores delayed musical sound waveform data obtained by sampling at the first sampling frequency $FS_1$, the plurality of multipliers which multiply the single directly received musical sound waveform data obtained by sampling at the first sampling frequency $FS_1$ and the musical sound waveform data obtained by sampling at the first sampling frequency $FS_1$ and held by the respective stages of the shift register, by the corresponding impulse response coefficients, and the adder (accumulator) which adds a value accumulated so far therein and a respective one of the outputs from the multipliers. Thus, the first convolution circuit performs the acquisition of the musical sound waveform data, the reading of the impulse response coefficients, the multiplication of the multipliers and the addition (accumulation) of the adder (accumulator) in parallel manner in the pipeline system. This applies to the second convolution circuit. Thus, these convolution circuits are implemented by a small number of multipliers and adders.

Further, in the embodiment, the first convolution circuit comprises 4 FIR filters with 1024 taps arranged such that musical sound waveform data obtained by sampling at the first sampling frequency $FS_1$ is shifted through these filters from the most upstream one to the most downstream one with a delay corresponding to the number of 1024 taps in each filter. Similarly, the second convolution circuit comprises 24 FIR filters with 1024 taps arranged such that musical sound waveform data obtained by sampling at the second sampling frequency $FS_2$ is shifted through these filters from the most upstream one to the most downstream one with a delay corresponding to the number of 1024 taps in each filter. This produces reverberation data containing an initial reflected sound and a later reverberation of a length sufficient to disappear gradually in a natural manner.

As described above, the second embodiment comprises first and second groups of FIR filters (80-0 to 80-4 and 80-5 to 80-28 of FIG. 8) composing parts of the first and second convolution circuits, respectively, of the first embodiment such that the respective ones of the first group of FIR filters perform the multiply-add operation based on the musical sound waveform data obtained by sampling at the first sampling frequency $FS_1$ and the respective ones of the second group of FIR filters perform the multiply-add operation based on the musical sound waveform data obtained by sampling at the second sampling frequency $FS_2$ smaller than the first sampling frequency (which is actually a half of the first sampling frequency).

The second embodiment of the present invention will be described more specifically. In addition to the composition of FIG. 8, the second embodiment further comprises a third group of FIR filters which compose a part of a third convolution circuit to perform a multiply-add operation based on musical sound waveform data obtained by sampling at a third sampling frequency $FS_3$ smaller than the second sampling frequency (for example, a half of the second sampling frequency).

Figure 13:
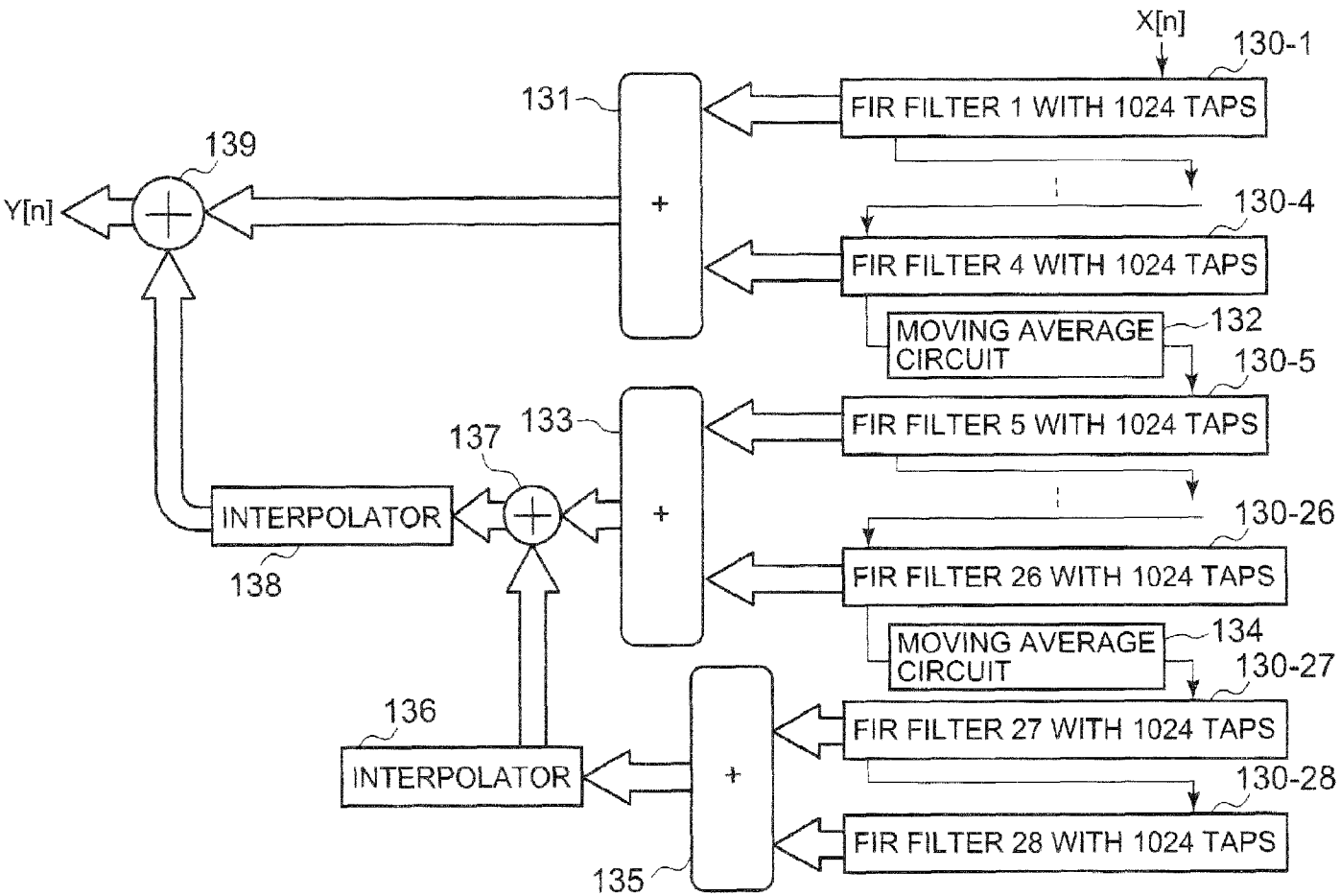
FIG. 13 illustrates a reverberation generator using a plurality of FIR filters according to a second embodiment of the invention.

FIG. 13 illustrates a reverberation generator using the plurality of FIR filters of the second embodiment. Also, this example implements the reverberation generator with 28 FIR filters with 1028 taps.

As shown in FIG. 13, the reverberation generator comprises 28 FIR filters 130-1 to 130-28, an adder (accumulator) 131 which adds outputs from four upstream FIR filters 130-1 to 130-4, a moving average circuit 132, a second adder (accumulator) 133 which adds outputs from 22 midstream FIR filters 130-5 to 130-26, a second moving average circuit 134, a third adder (accumulator) 135 which adds outputs from two downstream FIR filters 130-27 and 130-28, an interpolator 136, a fourth adder 137 which adds outputs from the third adder 133 and the interpolator 136, a second interpolator 138, and a fifth adder 139 which adds outputs from the adder 131 and the interpolator 138.

In the example of FIG. 13, the FIR filters 130-1 to 130-4 and the adder (accumulator) 131 compose a first convolution circuit; the FIR filters 130-5 to 130-26 and the second adder (accumulator) 133 compose a second convolution circuit; and the FIR Filters 130-27 and 130-28 and the third adder (accumulator) 135 compose a third convolution circuit.

In the FIR filters 130-1 to 130-3 of the first convolution circuit, musical sound waveform data is shifted at each clock and the musical sound waveform data outputted from the FIR filters 130-1 to 130-3 are inputted to downstream adjacent FIR filters 130-2 to 13-4, respectively. The musical sound waveform data outputted from the FIR filter 130-4 is inputted to the moving average circuit 132.

In the moving average circuit 132, averaged musical sound waveform data obtained by sampling at a second sampling frequency $FS_2$ is produced, which is then inputted to the FIR filter 130-5. In the FIR filters 130-5 to 130-26 of the second convolution circuit, the musical sound waveform data is shifted at each clock. The musical sound waveform data outputted from the FIR filters 130-5 to 130-25 are inputted to the adjacent downstream FIR filters 130-6 to 130-26, respectively The musical sound waveform data outputted from the FIR filter 130-26 is inputted to the second moving average circuit 134.

In the moving average circuit 134, averaged musical sound waveform data obtained by sampling at a third sampling frequency $FS_3$ is produced, which is then inputted to the FIR filter 130-27 of the third convolution circuit. In the FIR filters 130-27, the musical sound waveform data is shifted at each clock. The musical sound waveform data outputted from the FIR filters 130-27 is inputted to the adjacent downstream FIR filter 130-28. The configuration of each of the moving average circuits, interpolators and FIR filters is the same as a corresponding one of the first embodiment.

The multiply-add values outputted from the FIR filters 130-1 to 130-4 are added in the adder (accumulator) 131. The adder (accumulator) 131 sequentially adds a value accumulated so far therein (initially 0) and a multiply-add value from a respective one of the FIR filters 130-1 to 130-4 of the first convolution circuit. Thus, the multiply-add values from all the FIR filters 130-1 to 130-4 of the first convolution circuit are accumulated.

The musical sound waveform data averaged by the moving average circuit 132 is obtained by sampling at the second sampling frequency $FS_2$ which is a half of the first sampling frequency $FS_1$. Thus, if the FIR filters 130-5 to 130-26 of the second convolution circuit have the same number of taps as the FIR filters 130-1 to 130-4 of the first convolution circuit, the former realize multiplication of respective averaged musical sound data by corresponding impulse response coefficients twice as many as those used in the FIR filters 130-1 to 130-4 of the first convolution circuit on the time axis.

The multiply-add values outputted from the FIR filters 130-5 to 130-26 of the second convolution circuit are added in the adder (accumulator) 133. The adder (accumulator) 133 sequentially adds a value accumulated so far therein (initially 0) and a multiply-add value from a respective one of the FIR filters 130-5 to 130-26 of the second convolution circuit. Thus, the multiply-add values from all the FIR filters 130-5 to 130-26 of the second convolution circuit are accumulated.

The musical sound waveform data averaged by the moving average circuit 134 is obtained by sampling at the third sampling frequency $FS_3$ which is a half of the second sampling frequency $FS_2$. Thus, if the FIR filters 130-27 and 130-28 of the third convolution circuit have the same number of taps as the FIR filters 130-5 to 130-26 of the second convolution circuit, the former realize multiplication of respective averaged musical sound data by corresponding impulse response coefficients twice as many as those used in the FIR filters 130-5 to 130-26 of the second convolution circuit on the time axis.

In addition, the multiply-add values outputted from the FIR filters 130-27 and 130-28 of the third convolution circuit are added in the adder (accumulator) 135. The adder (accumulator) 135 sequentially adds a value accumulated so far therein (initially 0) and a multiply-add value from a respective one of the FIR filters 130-27 and 130-28. Thus, the multiply-add values from both the FIR filters 130-27 and 130-28 of the third convolution circuit are accumulated.

An output from the adder (accumulator) 135 obtained by sampling at the third sampling frequency $FS_3$ is inputted to the interpolator 136, which outputs an interpolated value and a multiply-add value repeatedly at the second sampling frequency $FS_2$.

The adder 137 adds outputs from the second adder (accumulator) 133 and the interpolator 136. An output from the fourth adder 137 obtained by sampling at the second sampling frequency $FS_2$ is further applied to the second interpolator 138. The interpolator 138 repeatedly outputs an interpolated value and a multiply-add value at the first sampling frequency $FS_1$. The configuration of each of the interpolators 136 and 138 is the same as the interpolator 82 of the first embodiment. The fifth adder 139 adds the outputs from the second interpolator 138 and the first adder (accumulator) 131 and outputs a result of the addition as reverberation data Y[n].

As in the first embodiment, in this second embodiment the accumulated multiply-add value from the second adder (accumulator) 133 is outputted actually with a delay of a predetermined time so as to coincide in time with the output from the first interpolator 136. Likewise, the accumulated multiply-add value from the adder (accumulator) 131 is outputted actually with a delay of a predetermined time so as to coincide in time with the output from the second interpolator 138.

The reverberation data Y[n] is outputted from the reverberation generator 30 and added to the musical sound waveform data from the sound generator 24 in the adder 32, which produces and delivers musical sound waveform data with reverberation data to the acoustic system 28, which in turn emanates a corresponding acoustic sound from the speaker.

According to the second embodiment, the first convolution circuit comprises 4 FIR filters with 1024 taps arranged such that each FIR filter delays musical sound waveform data obtained by sampling at the first sampling frequency by an amount corresponding to the number of 1024 taps and then inputs the delayed waveform data to an adjacent downstream FIR filter. The second convolution circuit comprises 24 FIR filters with 1024 taps arranged such that each FIR filter delays second musical sound waveform data, obtained by sampling at the second sampling frequency, by an amount corresponding to the number of 1024 taps and then inputs the delayed waveform data to an adjacent downstream FIR filter. The third convolution circuit comprises 24 FIR filters with 1024 taps arranged such that each FIR filter delays third musical sound waveform data, obtained by sampling at the third sampling frequency, by an amount corresponding to the number of 1024 taps and then inputs the delayed waveform data to an adjacent downstream FIR filter. This produces reverberation data containing an initial reflected sound and a later reverberation of a sufficient length.

While in the above embodiment the FIR filters with 1024 taps are used, the number of taps of the FIR filters is not limited to this example, but may be determined depending on the sampling frequency (first sampling frequency $FS_1$) at which the musical sound waveform data is sampled and the processing speed of the FIR filters.

The number of the FIR filters included in each of the first, second and third convolution circuits is not limited to the examples of the above embodiments.

In addition, while in the first and second embodiments the two and three convolution circuits are illustrated as provided, respectively, the number of convolution circuits may be more.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A reverberation effect adding device comprising:

an impulse response coefficient memory which has stored a plurality of impulse response coefficients;

first convolution means for receiving n musical sound waveform data sequentially in time series order, for sequentially delaying the first (n−1) ones of the n musical sound waveform data by (n−1), (n−2), . . . , and 1 stages, respectively, in a received order at a first sampling period, for reading n corresponding impulse response coefficients from the impulse response coefficient memory, for multiplying the delayed first (n−1) musical sound waveform data and the last received musical sound waveform data by the read n corresponding impulse response coefficients, respectively, and for adding respective results of the multiplications, thereby outputting a result of the addition;

conversion means for converting an output period of the n musical sound waveform data delayed by the n stages by the first convolution means to a second sampling period longer than the first sampling period, and for outputting the musical sound waveform data at the second sampling period;

second convolution means for sequentially receiving m ones of the musical sound waveform data outputted by the conversion means, for sequentially delaying the first (m−1) ones of the m musical sound waveform data by (m−1), (m−2), . . . , and 1 stages, respectively, in a received order at a second sampling period, for reading (m−1) corresponding impulse response coefficients and another impulse response coefficient corresponding to the last received musical sound waveform data from the impulse response coefficient memory, for multiplying the delayed first (m−1) musical sound waveform data and the last received musical sound waveform data by the read m corresponding impulse response coefficients, respectively, and for adding respective results of the multiplications, thereby outputting at the second sampling period a result of the additions;

inverse conversion means for inversely converting an output period of the results of the additions outputted from the second convolution means from the second sampling period to the first sampling period, thereby outputting the result of the additions at the first sampling period; and addition means for adding the result of the additions outputted from the inverse conversion means at the first sampling period and the result of the addition outputted from the first convolution means.

2. The reverberation effect adding device of claim 1, wherein the conversion means comprises moving average operating means for performing a moving average operation on the results of the additions from the first convolution means received sequentially at the first sampling period, and for outputting a result of the operation at the second sampling period.

3. The reverberation effect adding device of claim 1, wherein the inverse conversion means comprises interpolation means for interpolating the results of the additions received sequentially from the second convolution means at the second sampling period, and for outputting a resulting interpolated value or the results of the additions from the second convolution means at the first sampling period.

4. A reverberation effect adding device comprising:

an impulse response coefficient memory which has stored a plurality of impulse response coefficients;

a plurality of ($1^{st}$-$s^{th}$) convolution means where s=2, 3, 4, . . . S each for receiving n musical sound waveform data sequentially in time series order, for sequentially delaying the received first (n−1) ones of the n musical sound waveform data by (n−1), (n−2), . . . , and 1 stages, respectively, in a received order at a sampling period set in that convolution means, the sampling period set in any $s^{th}$ convolution means being shorter than that of $(s+1)^{th}$ convolution means of following order, for reading n impulse response coefficients corresponding to the delayed first (n−1) musical sound waveform data and the last received musical sound waveform data from the impulse response coefficient memory, for multiplying the delayed first (n−1) musical sound waveform data and the last received musical sound waveform data by the read n corresponding impulse response coefficients, respectively, and for adding respective results of the multiplications, thereby outputting a result of the addition;

a plurality of conversion means each provided for a respective one of the plurality of convolution means excluding the $1^{st}$ convolution means for converting an output period of the musical sound waveform data outputted from that convolution means to the sampling period set in the convolution means of following order, and for supplying the musical sound waveform data at the converted sampling period to the convolution means of following order;

a plurality of inverse conversion means each provided for a respective one of the plurality of convolution means excluding the $1^{st}$ convolution means for inversely converting an output period of the result of the addition outputted sequentially from that convolution means to the sampling period of the convolution means of preceding order; and a plurality of addition means each provided for a respective one of the plurality of convolution means excluding the $S^{th}$ convolution means for adding the result of the addition outputted from that convolution means, whose sampling period is changed to the sampling period set in the conversion means of preceding order, by the inverse conversion means provided for that convolution means and the result of the addition outputted from the convolution means of preceding order, and for outputting a result of the addition to the conversion means provided for the convolution means of preceding order.

5. The reverberation effect adding device of claim 4, wherein each conversion means comprises moving average operating means for performing a moving average operation on the results of the additions received sequentially from that convolution means at its sampling period, and for outputting a result of the moving average operation at the sampling period set in the convolution means of following order.

6. The reverberation effect adding device of claim 4, wherein each inverse conversion means comprises interpolation means for interpolating results of additions received sequentially from that convolution means at its sampling period, and for outputting a resulting interpolated value or the results of additions received from that convolution means at the sampling period set in the convolution means of preceding order.

* * * * *